United States Patent [19]

Nishiyama et al.

[11] Patent Number: 4,772,545

[45] Date of Patent: Sep. 20, 1988

[54] HIGH SPEED SILVER HALIDE PHOTOGRAPHIC MATERIALS

[75] Inventors: Shingo Nishiyama; Kiyoshi Kawai, both of Kanagawa, Japan

[73] Assignee: Fuji Photo Film Co., Ltd., Kanagawa, Japan

[21] Appl. No.: 888,174

[22] Filed: Jul. 22, 1986

[30] Foreign Application Priority Data

Jul. 22, 1985 [JP] Japan ..... 61-161456

[51] Int. Cl.[4] ..... G03C 1/02; G03C 1/06; G03C 5/24

[52] U.S. Cl. ..... 430/564; 430/438; 430/439; 430/440; 430/441; 430/442; 430/445; 430/447; 430/611; 430/612; 430/957

[58] Field of Search ..... 430/611, 612, 564, 957, 430/445, 447, 438, 439, 440, 441, 442

[56] References Cited

U.S. PATENT DOCUMENTS

| | | | |
|---|---|---|---|
| 3,432,304 | 3/1969 | Saleck et al. | 430/612 X |
| 3,639,128 | 2/1972 | Matejec et al. | 430/612 |
| 4,258,129 | 3/1981 | Ikenoue et al. | 430/612 X |
| 4,279,983 | 7/1981 | Bilofsky et al. | 430/612 X |
| 4,355,101 | 10/1982 | Mehta et al. | 430/957 X |
| 4,451,561 | 5/1984 | Hirabayashi et al. | 430/611 |
| 4,543,317 | 9/1985 | Mehta et al. | 430/611 X |
| 4,624,913 | 11/1986 | Miyasaka et al. | 430/445 X |

FOREIGN PATENT DOCUMENTS

| | | |
|---|---|---|
| 742219 | 12/1955 | United Kingdom . |
| 1067066 | 5/1967 | United Kingdom . |

*Primary Examiner*—Mukund J. Shah

*Attorney, Agent, or Firm*—Sughrue, Mion, Zinn, Macpeak & Seas

[57] ABSTRACT

A silver halide photographic material in which a silver iodobromide emulsion having an iodide content of 2 mole % or more and an organometallic salt functioning as a development inhibitor are employed in combination, whereby an improvements in graininess and sharpness of a developed image are achieved and high photographic speed is retained.

A process for producing silver images using the silver halide photographic material is also disclosed.

13 Claims, No Drawings

HIGH SPEED SILVER HALIDE PHOTOGRAPHIC MATERIALS

FIELD OF THE INVENTION

The present invention relates to a silver halide photographic material, and more particularly, to a black and white photographic light-sensitive material for picture-taking use which is excellent in not only photographic speed, but also in graininess and sharpness.

BACKGROUND OF THE INVENTION

The development of silver halide photographic materials involved a long-series of struggles seeking methods by which increases in photographic speed could be achieved and deteriorations in graininess and developed image sharpness, which tend to increase with increasing photographic speed, could be suppressed to the minimum.

In general, high photographic speed can be attained by increasing the size of the silver halide grains used. Such is, however, well known to cause a deterioration of the image produced in graininess and sharpness.

Conversely, decreasing the size of silver halide grains is known to bring about an improvement in graininess. However, it is also well known that a decrease in grain size reduces photographic speed.

A large number of means for increasing the photographic speed of silver halide grains as their size remains relatively small have been investigated. For instance, an attempt to increase photographic speed by increasing the iodide content in the halide composition of silver halide grains was made. However, this proved to be not so successful.

On the other hand, there are known methods of improving graininess through the inhibition of development where triazoles or tetrazoles are incorporated as development inhibitor into a light-sensitive material.

However, such development inhibitors restrain development uniformly, regardless of the image density to be developed. Accordingly, they do not necessarily have satisfactory effects upon improving the graininess and sharpness of developed image.

Consequently, it has been highly desired to develop a means which makes it feasible to allow development inhibition to proceed in proportion to the density to be developed, that is, whereby development in an image area can be retarded to a greater extent the higher the density to be developed therein is, whereby a remarkable improvement in graininess and sharpness can be achieved.

SUMMARY OF THE INVENTION

A first object of the present invention is to provide a silver halide photographic material which has high photographic speed and is excellent in graininess and sharpness.

A second object of the present invention is to provide a method of improving graininess and sharpness by retarding development in proportion to the density an image area is to have.

These objects of the present invention have been attained by employing a silver iodobromide emulsion comprising silver halide grains in which the halide composition is not less than 2 mole% iodide and the remainder bromide, further using an organometallic salt as a development inhibitor.

DETAILED DESCRIPTION OF THE INVENTION

Organometallic salts employable in the present invention are described in detail below.

The term "organometallic salt" as used in the present invention is intended to include the salts prepared from heterocyclic compounds containing at least one hetero atom selected from the group consisting of a sulfur atom, an oxygen atom and a nitrogen atom, and metal ions. The preferable heterocyclic compounds include 5- or 6-membered heterocyclic compounds having from 2 to 4 hetero atoms selected from the group consisting of a sulfur atom, an oxygen atom and a nitrogen atom.

Heterocyclic compounds suitable for preparing the metallic salts of the present invention are preferably those having a development inhibiting effect, with specific examples including triazoles, tetrazoles, imidazoles, thiazoles, thiadiazoles, oxazoles, thiazolines, imidazoline, pyrimidines and the like. The heterocyclic compounds may have at least one substituent, such as an alkyl group preferably containing 1 to 8 carbon atoms (e.g., methyl group, ethyl group, propyl group, etc.), an alkylamino group preferably containing 1 to 8 carbon atoms (e.g., methylamino group, ethylamino group, etc.), an acylamido group preferably containing 1 to 5 carbon atoms (e.g., acetamido group, etc.), an aryl group preferably containing 6 to 12 carbon atoms (e.g., phenyl group, etc.), and an alkylmercapto group preferably containing 1 to 8 carbon atoms (e.g., methylmercapto group, ethylmercapto group, etc.) or may have at least two substituents which combine together to form a benzene ring. Of these heterocyclic compounds, those having a mercapto group as a substituent group are most preferred over others.

General formulae of preferred heterocyclic compound are illustrated below.

(1) Mercaptotriazoles

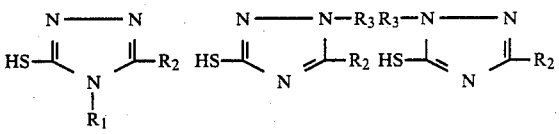

(2) Mercaptothiadiazoles

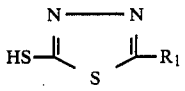

(3) Mercaptoimidazoles

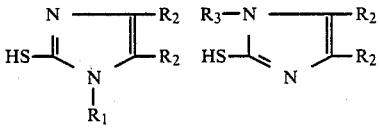

(4) Mercaptotetrazoles

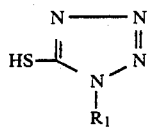

In the foregoing general formulae, $R_1$ represents a hydrogen atom, an alkyl group, an amino group, an alkylamino group, an acylamido group, or an aryl group; $R_2$ represents a hydrogen atom, an alkyl group, an amino group, an alkylamino group, an alkylmercapto group, or a halogen atom; and $R_3$ represents a hydrogen atom, or an alkyl group.

Preferable embodiments for $R_1$, $R_2$ and $R_3$ are the same as in the case of substituents for the heterocyclic compounds described above.

Preferable metal ions are those which are removable from the organometallic salt and which form insoluble salts by a reaction with a halogen ion released on development, and the metal ions should not cause harmful effects on the photographic characteristics.

Preferable examples of metal ions include silver, gold, copper, nickel, palladium, zinc, rhodium, platinum and lead ions.

Organometallic salts which are preferably employed in the present invention are those having a $pK_{sp}$ value of 13 to 17.

Specific examples of organometallic salts which can be used in the present invention are set forth below. However, the present invention should not be construed as being limited to the following examples.

1. 1-Phenyl-5-mercaptotetrazole silver
2. 2-Mercapto-benzothiazoles silver
3. 2-Mercapto-benzimidazole silver
4. 3-Mercapto-1,2,4-triazole silver
5. 4-Amino-3-mercapto-1,2,4-triazole silver
6. 2-Mercapto-5-amino-thia-3,4-diazole silver
7. 2-Mercapto-imidazole silver
8. 5-Mercapto-tetrazole silver The organometallic salt of the present invention is used, preferably, in an amount of $1\times10^{-5}$ g to $1\times10^{-1}$ g, particularly preferably $5\times10^{-4}$ g to $5\times10^{-2}$ g, per square meter of the silver halide light-sensitive material. A suitable ratio of the organometallic salt of the present invention to silver halide(s) contained in the sensitive material ranges from $10^{-2}$:1 to $10^{-6}$:1 by mole.

The organometallic salt of the present invention is preferably added to a light-sensitive emulsion layer comprising silver iodobromide grains.

The silver iodobromide emulsion in accordance with the present invention has a silver iodide content of 2 mole% or more, preferably from 2 mole% to the maximum solid solubility, i.e., about 40 mole%. More preferably, silver iodide contents ranging from 2 to 20 mole% most preferably from 2 to 10 mole% are advantageous in the silver halide grains of the present invention.

Optically exposed silver halide grains are reduced to silver by a reducing agent (developing agent) in an aqueous developing solution, and the halogen ions are released into the aqueous solution. If iodine ion is present among the halogen ions released at this time and, further, an organometallic salt having a solubility higher than AgI has is present in the neighborhood of the iodide ions, interconversion between iodine ions and the organometallic salt takes place to result in the release of the organic compound. If this organic compound is a development inhibitor, development of the silver halide grains can be retarded. Imagewise inhibition of development becomes possible by the above described mechanism. The efficiency of inhibition depends on the iodine content in the emulsion used. Specifically, at least 2 mole % of iodine is required for marked inhibition. In addition, water is essential for initiating the above described interconversion.

The silver iodobromide emulsion of the present invention may contain silver chloride in such a fraction as not to have any substantial effects upon photographic properties, specifically 1 mole % or less.

The silver halide grains of the present invention are not particularly restricted as to crystal form, and not only may the grains having a regular form, such as that of a cube, an octahedron, a tetradecahedron or the like, but also twin axis grains, such as tubular grains having an aspect ratio of 5 or more, as described in *Research Disclosure,* volume 225, pages 20 to 58. (January 1983) and pebble like grains, can be employed. The size of silver halide grains used in the present invention preferably ranges within from 0.3 μm to 2.0 μm in diameter. Iodide ions are distributed uniformly in the grains or contained in a layer inside the grains in a high amount to form dual structural grains. The latter distribution is preferable. The silver halide emulsion employed in the present invention can be prepared using various conventional methods as described in, for example, T. H. James, *The Theory of the Photographic Process,* 4th Ed., Macmillian, New York (1976); P. Glafkides, *Chimie et Physique Photographique,* Paul Montel, Paris (1957); and so on. Namely, a conventional acid process, a neutral process, an ammonia process and other conventional processes may be employed, and suitable methods for reacting a water-soluble silver salt with a water-soluble halide include a conventional single jet method, a double jet method and a combination thereof.

Also, a method in which silver halide grains are produced in the presence of excess silver ion (a so-called reverse mixing method) can be employed in the present invention. On the other hand, a so-called controlled double jet method, in which the pAg of the liquid phase in which silver halide grains are to be precipitated is maintained constant, may also be employed therein. According to this method, a silver halide emulsion which contains the grains having a regular crystal form and is nearly uniform in grain size can be obtained. All such methods are conventional.

Two or more kinds of silver halide emulsions prepared separately may be used as a mixture, if desired.

In a process for producing silver halide grains or allowing the produced silver halide grains to ripen physically, cadmium salts, zinc salts, lead salts, thallium salts, iridium salts or complexes, rhodium salts and complexes, iron salts and complexes, and/or the like may be present in conventional amounts.

In addition, it is to be preferred that the grain formation be carried out in the presence of a silver halide solvent, such as ammonia, thioether compounds, or so on, in a conventional manner.

The silver halide emulsion to be employed in the present invention is chemically sensitized in a conventional manner as is described in U.S. Pat. Nos. 2,399,083, and 2,739,060, and *Research Disclosure* volume 12008 (April, 1974) and ibid. volume 17643 III (December, 1978).

Specifically, sulfur sensitization processes using active gelatin or compounds containing sulfur capable of reacting with silver ion (e.g., thiosulfates, thioureas, mercapto compounds, and rhodanines), reduction sensitization processes using reducing materials (e.g., stannous salts, amines, hydrazine derivatives, formamidinesulfinic acid, and silane compounds), and noble sensitization processes using noble metals (e.g., gold compounds, and complex salts of Group VIII metals such as platinum, iridium, palladium, etc.) can be employed individually or as a combination thereof in order to effect chemical sensitization.

The photographic emulsions employed in the present invention can contain a wide variety of compounds for the purposes of preventing fogging and stabilizing photographic functions during production, storage or photographic processing. More specifically, azoles (e.g., benzothiazolium salts, nitroimidazoles, nitrobenzimidazoles, chlorobenzimidazoles, bromobenzimidazoles, nitroindazoles, benzotriazoles, aminotriazoles and the like), mercapto compounds (e.g., mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines, mercaptotriazines and so on), thioketo compounds like oxazolinethione; azaindenes (e.g., triazaindenes, tetrazaindenes (especially (1,3,3a,7)tetrazaindenes substituted with a hydroxy group at the 4-position), pentazaindenes and so on), benzenethiosulfonic acids, benzenesulfinic acids, benzenesulfonic acid amides, and many other compounds known as an antifoggant or a stabilizer can be added to the photographic emulsion of the present invention.

The silver halide emulsion of the present invention is not particularly restricted as to coating coverage. However, a very suitable coverage of silver per layer is 0.5 to 10 g/m$^2$, particularly preferably 1 to 5 g/m$^2$.

A silver halide emulsion layer of the present invention is not particularly restricted as to thickness. However, a very suitable thickness of such a layer ranges from 0.5 to 10 microns, particularly preferably 1 to 5 microns.

In addition to the emulsion layer comprising silver iodobromide as described above, the silver halide photographic material of the present invention may comprise, and generally will comprise, various hydrophilic colloid layers, such as other silver halide emulsion layers, and light-insensitive layers (e.g., surface protective layer, interlayers, reflective layer, antihalation layer, organometallic salt layer and so on).

Ingredients of the silver iodobromide emulsion layer of the present invention and other hydrophilic colloid layers are described in detail below.

Gelatin is employed to advantage as a binder or a protective colloid which can be employed in emulsion layers and interlayers to yield the light-sensitive material of the present invention. Hydrophilic colloids other than gelatin can also be used. For instance, other conventional colloids which can be used include proteins such as gelatin derivatives, graft copolymers of gelatin and other high polymers, albumin, casein, etc.; sugar derivatives such as cellulose derivatives (e.g., hydroxyethyl cellulose, carboxymethyl cellulose, cellulose sulfate, etc.), sodium alginate, starch derivatives and the like; and various kinds of synthetic hydrophilic macromolecular substances such as homo- or co-polymers including polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, and so on.

The photographic emulsion layers and other hydrophilic colloid layers which constitute the photographic material of the present invention may contain conventional inorganic or organic hardeners. Examples of hardeners which may be used include chromium salts (e.g., chrome alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), and mucohalogen acids (e.g., mucochloric acid, mucophenoxychloric acid, etc.), alone or as a combination thereof.

The photographic emulsion layers and other hydrophilic colloid layers of the present light-sensitive materials may contain various kinds of conventional surface active agents for a wide variety of purposes, such as a coating aid, prevention of electrification, improvement in slipping property, emulsifying and dispersing, prevention of adhesion, and improvements in photographic characteristics (e.g., development acceleration, high contrast, sensitization, etc.), and so on.

Examples of surface active agents which can be employed include nonionic surface active agents such as saponin (steroid type), alkylene oxide derivatives (e.g., polyethylene glycol, polyethylene glycol/polypropylene glycol condensates, polyethylene glycol alkyl ethers or polyethylene glycol alkyl aryl ethers, polyethylene glycol ethers, polyethylene glycol sorbitan esters, polyalkylene glycol alkylamines or amides, polyethylene oxide adducts of silicone, etc.), glycidol derivatives (e.g., alkenylsuccinic acid polyglycerides, alkylphenol polyglycerides, etc.), fatty acid esters of polyhydric alcohols, alkyl esters of sugar, and so on; anionic surface active agents containing an acid group(s) (e.g., a carboxyl group, a sulfo group, a phospho group, a sulfate group, a phosphate group, etc.), such as alkylcarboxylates, alkylsulfonates, alkylbenzenesulfonates, alkylnaphthalenesulfonates, alkylsulfates, alkylphosphates, N-acyl-N-alkyltaurine, sulfosuccinates, sulfoalkylpolyoxyethylene alkyl phenyl ethers, polyoxyethylene alkylphosphates, etc.; amphoteric surface active agents such as amino acids, aminoalkylsulfonates, aminoalkylsulfates, aminoalkylphosphates, alkylbetaines, amine oxides, etc.; and cationic surface active agents such as alkylamines, aliphatic or aromatic quaternary ammonium salts, heterocyclic quaternary ammonium salts like pyridinium, imidazolium and so on, phosphonium or sulfonium salts containing an aliphatic or a hetero ring, and so on.

The photographic emulsions employed in the present invention may be conventionally spectrally sensitized using methine dyes or other dyes. Suitable spectral sensitizing dyes which can be used include cyanine dyes, merocyanine dyes, complex cyanine dyes, complex merocyanine dyes, holopolar cyanine dyes, hemicyanine dyes, styryl dyes, and hemioxonol dyes. Especially useful dyes are cyanine dyes, merocyanine dyes and complex merocyanine dyes. Any nuclei usually present in cyanine dyes can be the basic heterocyclic nuclei of these dyes. More specifically, basic heterocyclic nuclei include pyrroline, oxazoline, thiazoline, pyrrole, oxazole, thiazole, selenazole, imidazole, tetrazole, pyridine and like nuclei; nuclei formed by fusing together one of the above-described nuclei and an alicyclic hydrocarbon ring; and nuclei formed by fusing together one of the above-described nuclei and an aromatic hydrocarbon ring. Specific examples of these nuclei include indolenine, benzindolenine, indole, benzoxazole, naphthoxazole, benzothiazole, naphthothiazole, benzoselenazole, benzimidazole, quinoline and like nuclei. Carbon atoms of these nuclei may have one or more substituents.

The merocyanine and complex merocyanine dyes can contain 5- or 6-membered heterocyclic nuclei such as pyrazoline-5-one, thiohydantoin, 2-thioxazolidine-2,4-dione, thiazolidine-2,4-dione, rhodanine, thiobarbituric acid and like nuclei, as ketomethylene structure-containing nuclei.

In order to increase photographic speed and contrast, or in order to accelerate developing rate, the photographic emulsion layers which constitute the photographic light-sensitive material of the present invention may contain, for example, polyalkylene oxides and derivatives thereof, such as the ethers, the esters and the amines thereof, thioether compounds, thiomorpholines, quaternary ammonium salt compounds urethane derivatives, urea derivatives, imidazole derivative, 3-pyrazolidones and so on. More specifically, those described in U.S. Pat. Nos. 2,400,532, 2,423,549, 2,716,062, 3,617,280, 3,772,021 and 3,808,003, British Pat. No. 1,488,991, and so on can be employed.

Photographic emulsion layers and other hydrophilic colloid layers of the photographic light-sensitive material according to the present invention can contain dispersions of conventional water insoluble or slightly soluble synthetic polymers for the purpose of improving dimensional stability and so on. Suitable polymers include, e.g., those containing as constituent monomers an alkyl(metha)acrylate, an alkoxyalkyl(meth)acrylate, a glycidyl(metha)acrylate, a (metha)acrylamide, a vinyl ester (e.g., vinyl acetate), acrylonitrile, an olefin, a styrene and so on individually or as a combination of two or more thereof, or as a combination of one or more of the above-described monomers with acrylic acid, methacrylic acid, an $\alpha,\beta$-unsaturated dicarboxylic acid, a hydroxyalkyl(metha)acrylate, a sulfoalkyl(metha)acrylate, a styrene sulfonic acid, and so on.

The photographic light-sensitive material of the present invention may contain conventional color image-forming couplers, that is to say, compounds capable of forming colors by oxidation coupling with aromatic primary amine developing agents (e.g., phenylenediamine derivatives, aminophenol derivatives, etc.) upon color development processing. It is desirable for these couplers to be rendered nondiffusible by their hydrophobic group functioning as a ballast group, or by having a polymeric form. these couplers may be either two-equivalent or four-equivalent to a silver ion. Colored couplers having a color correction effect, or couplers capable of releasing a development inhibitor upon development (DIR couplers) may be incorporated in the photographic light-sensitive material of the present invention. Besides DIR couplers, colorless DIR coupling compounds which can yield colorless products upon the coupling reaction and can release development inhibitors may also be incorporated.

Specific examples of magenta couplers which can be used include 5-pyrazolone couplers, pyrazolobenzimidazole couplers, cyanoacetylcumarone couplers, open-chain acylacetonitrile couplers and so on. Specific examples of yellow couplers which can be used include acylacetoamide couplers (e.g., benzoylacetoanilides, pivaloylacetoanilides, etc.) and so on. Specific examples of cyan couplers which can be used include naphthol couplers, phenol couplers and so on.

The photographic light-sensitive material of the present invention is not particularly restricted as to other ingredients thereof, and descriptions, e.g., in *Research Disclosure,* volume 176, RD-17643 (December 1978), and ibid., volume 187, RD-18716 (November 1979) can be referred to for various other conventional additives which can be used.

Where disclosure on various additives is located in the foregoing references is set forth below.

| Additive | RD-17643 | RD-18716 |
|---|---|---|
| 1. Chemical Sensitizers | p.23 | p.648, right column |
| 2. Photographic Speed Increasing Agents | — | p.648, right column |
| 3. Spectral Sensitizers and Supersensitizers | p.23 and p.24 | from p.648, right column to p.649, right column |
| 4. Antifoggants and Stabilizers | p.24 and p.25 | p.649, right column |
| 5. Light absorbents, Filter Dyes, and Ultraviolet Absorbents | p.25 and p.26 | from p.649, right column to p.650, left column |
| 6. Stain Inhibitors | p.25, right column | p.650, from left to right column |
| 7. Hardeners | p.26 | p.651, left column |
| 8. Binders | p.26 | p.651, left column |
| 9. Plasticizers and Lubricants | p.27 | p.650, right column |
| 10. Coating Aids and Surface Active Agents | p.26 and p.27 | p.650, right column |
| 11. Antistatic Agents | p.27 | p.650, right column |
| 12. Color Couplers | p.25 | p.649, right column |

For the reaction of image-wise releasing a development inhibitor by the combined use of a silver iodobromide emulsion having a silver iodide content of 2 mole % or more and an organometallic salt according to the present invention, as described in detail above, it is essential that water intermediates between the silver iodobromide and the organometallic salt. In this point, the photographic light-sensitive material of the present invention differs fundamentally from dry silver system.

Consequently, the light-sensitive material of the present invention is processed with an aqueous developing solution containing a developing agent.

Any known processing method and any known processing solution can be employed in the present invention. The processing temperature is generally in the range of about 18° C. to about 50° C. Of course, temperatures higher than about 50° C., e.g., 70° C., or lower than about 18° C. may be employed.

The present invention has a particularly marked effect in black and white photographic materials for picture-taking use. In a black and white developing solution, known developing agents such as dihydroxybenzenes (e.g., hydroquinone), 3-pyrazolidones (e.g., 1-phenyl-3-pyrazolidone), aminophenols (e.g., N-methyl-p-aminophenol) and so on can be used alone or in combination of two or more thereof.

The ingredients to form the photographic material of the present invention are used in a most preferable amount unless otherwise stated.

The present invention is now illustrated in greater detail by reference to the following Examples.

EXAMPLE 1

(i) Preparation of Emulsion:

Solution B and Solution C were simultaneously added to Solution A placed in a reactor kept at 65° C. over a period of 30 minutes. The compositions of these solutions are described below.

Emulsions A to E were prepared changing the amount of KI in Solution A. Specifically, the amount of KI used was zero in Emulsion A, 2.3 g in Emulsion B, 4.7 g in Emulsion C, 7 g in Emulsion D, and 12 g in Emulsion E.

Emulsions A to E thus prepared were chemically sensitized using sodiumthiosulfate and chloroauric acid under a condition of pH 6.5, pAg 8.6 at 50° C.

Composition of Solution A

| | |
|---|---|
| Gelatin (lime processed gelatin) | 20 g |
| KBr | 25 g |
| KI | described above |
| $NH_3$ | 12 g |
| Water | 850 ml |

Composition of Solution B

| | |
|---|---|
| Silver Nitrate | 120 g |
| Water | 580 ml |

Composition of Solution C

| | |
|---|---|
| KBr | 65 g |
| Water | 580 ml |

(ii) Production of Samples:

To each emulsion, sodium dodecylbenzenesulfonate and 1-phenyl-5-mercaptotetrazolesilver or 1-phenyl-5-mercaptotetrazole were added in amounts as set forth in Table 1. The resulting emulsion and a coating composition for a surface protecting layer (a 10% aqueous gelatin solution containing sodium 2,4-dichloro-6-hydroxy-s-triazine, sodium dodecylbenzene sulfonate and finely divided polymethylmethacrylate particles) were coated on a cellulose acetate film using a simultaneous coating technique in a coating amount of $5\times10^{-2}$ g/m$^2$ of sodium 2,4-dichloro-6-hydroxy-s-triazine, $2\times10^{-2}$ g/m$^2$ of sodium dodecylbenzene sulfonate and 0.4 g/m$^2$ of polymethylmethacrylate. Thus, samples (11 samples) as described in Table 1 were produced. The coverage of silver in each sample was 4 g/m$^2$.

(iii) Comparison of Properties:

Each sample was exposed to light through an optical wedge and, thereafter, developed with a developing solution having the following formula at 20° C. for 7 minutes, whereby photographic speed, development inhibition rate ($D/D_o$) and granularity of the samples were compared with one another.

Formula of Developing solution Used;

| | |
|---|---|
| p-Methylaminophenol Sulfate | 2 g |
| Sodium sulfate | 100 g |
| Hydroquinone | 5 g |
| Borax (decahydrate) | 2 g |
| Water to make | 1 l |

Determination of Photographic Speed;

Photographic speed is represented by a reciprocal value of an exposure amount to provide an optical density of [fog+0.1]; photographic speeds are shown as relative velues in each group of the samples having the same silver iodide content, with the sample in which neither 1-phenyl-5-mercaptotetrazolesilver nor 1-phenyl-5-mercaptotetrazole was present being taken as 100.

Definition of $D/D_o$;

The development inhibition rate is represented by the ratio of the density (D) of a development inhibitor present sample to the density ($D_o$) of a development inhibitor absent sample, with the densities being achieved under an exposure amount more than that necessary for the development inhibitor absent sample to produce a density of [fog+0.10], by 1.0 (=log) expressed as a common logarithm.

Determination of Granularity;

For the purpose of evaluating granularity, a developed sample was examined for density using an aperture having a diameter of 48 μm. RMS granularity is defined as $\sigma_A$ represented by the following equation:

$$\sigma_A^2 = \frac{1}{N}\sum_{i=1}^{N}(D_i - D)^2$$

wherein $\overline{D}$ represents an average density (0.80), and Di represents the density measured at an individual spot through the aperture. In Table 1, granularity is represented by the ratio of the RMS value of a development inhibitor present sample (RMS) to that of a development inhibitor absent sample $\{(RMS)_0\}$.

As can be seen from the results in Table 1, Sample 2', 3', 4' and 5' according to the present invention showed only a slight decrease in photographic speed, exhibited a marked effect with respect to development inhibition, and had excellent granularity.

On the other hand, the decrease in photographic speed caused in Sample 4" in which 1-phenyl-5-mercaptotetrazole was incorporated in intact form was so great that the same could not be practically used.

TABLE 1

| Sample | Halide Composition of Emulsion | Development Inhibitor (g/m$^2$) | Photographic Speed | $D/D_o$ | Granularity $(RMS)/(RMS)_o$ |
|---|---|---|---|---|---|
| 1 | AgBr | — | 100 | 1 | 1 |
| 1' | AgBr | PMT-Ag ($3\times10^{-3}$) | 113 | 1.05 | 1.02 |
| 2 | AgBrI (I: 2%) | — | 100 | 1 | 1 |
| 2' (Invention) | AgBrI (I: 2%) | PMT-Ag ($3\times10^{-3}$) | 94 | 0.99 | 0.96 |
| 3 | AgBrI (I: 4%) | — | 100 | 1 | 1 |
| 3' (Invention) | AgBrI (I: 4%) | PMT-Ag ($3\times10^{-3}$) | 92 | 0.89 | 0.92 |
| 4 | AgBrI (I: 6%) | — | 100 | 1 | 1 |
| 4' (Invention) | AgBrI (I: 6%) | PMT-Ag ($3\times10^{-3}$) | 86 | 0.73 | 0.87 |
| 4" | AgBrI (I: 6%) | PMT ($1.9\times10^{-3}$) | 52 | 0.69 | |
| 5 | AgBrI (I: 10%) | — | 100 | 1 | 1 |

TABLE 1-continued

| Sample | Halide Composition of Emulsion | Development Inhibitor ($g/m^2$) | Photographic Speed | $D/D_o$ | Granularity $(RMS)/(RMS)_o$ |
|---|---|---|---|---|---|
| 5' (Invention) | AgBrI (I: 10%) | PMT-AG ($3 \times 10^{-3}$) | 84 | 0.40 | 0.81 |

PMT-Ag is 1-phenyl-5-mercaptotetrazolesilver and PMT is 1-phenyl-5-mercaptotetrazole.

While the invention has been described in detail and with reference to specific embodiments thereof, it will be apparent to one skilled in the art that various changes and modification can be made therein without departing from the spirit and scope thereof.

What is claimed is:

1. A silver halide photographic material having on a support at least one light-sensitive silver halide emulsion layer, said emulsion layer comprising silver iodobromide grains in which the silver iodide content in the silver halide is not less than 2 mole % and said photographic material containing a metallic salt in said emulsion layer or another constituent layer, wherein the metal ion of said metallic salt is selected from the group consisting of silver, gold, copper, nickel, palladium, zinc, rhodium, platinum and lead ions, and wherein said metallic salt is prepared from a heterocyclic compound containing at least one hetero atom selected from the group consisting of a sulfur atom, and oxygen atom and a nitrogen atom, and said metal ion.

2. A silver halide photographic material as in claim 1, wherein the organometallic salt is a salt prepared from heterocyclic compound containing at least one hetero atom selected from the group consisting of a sulfur atom, an oxygen atom and a nitrogen atom, and metal ions.

3. A silver halide photographic material as in claim 2, wherein the heterocyclic compound is a 5- or 6-membered heterocyclic compound having from 2 to 4 hetero atoms selected from the group consisting of a sulfur atom, an oxygen atom and a nitrogen atom.

4. A silver halide photographic material as in claim 1, wherein the organometallic salt has a $pK_{sp}$ value of 13 to 17.

5. A silver halide photographic material as in claim 1, wherein the organometallic salt is a salt prepared from the following heterocyclic compound and metal ions.

(1) Mercaptotriazoles

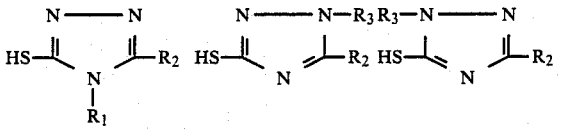

(2) Mercaptothiadiazoles

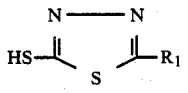

(3) Mercaptoimidazoles

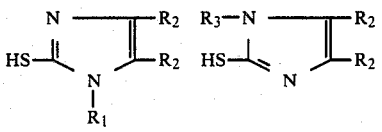

(4) Mercaptotetrazoles

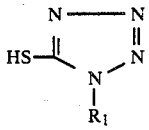

wherein, $R_1$ represents a hydrogen atom, an alkyl group, an amino group, an alkylamino group, an acylamido group, or an aryl group; $R_2$ represents a hydrogen atom, an alkyl group, an amino group, an alkylamino group; an alkylmercapto group, or a halogen atom; and $R_3$ represents a hydrogen atom, or an alkyl group.

6. A silver halide photographic material as in claim 1, wherein the metal ion is one which is removable from the organometallic salt and which forms insoluble salt by a reaction with a halogen ion released on a development.

7. A silver halide photographic material as in claim 1, wherein the silver halide content is from 2 mole % to 20 mole %.

8. A silver halide photographic material as in claim 1, wherein the organometallic salt is used in an amount of $1 \times 10^{-5}$ g to $1 \times 10^{-1}$ g, per square meter of the silver halide photographic material.

9. A process for producing silver images comprising processing an imagewise exposed silver halide photographic material having on a support at least one light-sensitive silver halide emulsion layer, said emulsion layer comprising silver iodobromide grains in which the silver iodide content in the silver halide is not less than 2 mole % and said photographic material containing a metallic salt prepared from a heterocyclic compound and a metallic ion, which heterocyclic compound is a 5- or 6-membered heterocyclic compound having from 2 to 4 hetero atoms selected from the group consisting of a sulfur atom, an oxygen atom and a nitrogen atom, which metallic salt has a development inhibiting effect in said emulsion layer or another constituent layer, with a developer containing a developing agent, whereby the silver halide photographic material undergoes imagewise inhibition of development.

10. A process for producing developed images as in claim 9, wherein the developing agent is one selected from the group consisting of dihydroxybenzenes, 3-pyrazolidones, aminophenols and two or more combinations thereof.

11. A process for producing developed images as in claim 10, wherein the developing agent is hydroquinone.

12. A process for producing developed images as in claim 10, wherein development is processed at a temperature of from 18° C. to 50° C.

13. The process for producing developed images as in claim 9, wherein the imagewise exposed silver iodobromide grains are reduced to silver by the developing agent, releasing iodine ions, whereby the organometallic salt undergoes interconversion with the iodide ions to release the heterocyclic compound having a development inhibiting effect from the organometallic salt.

* * * * *